US006808072B2

(12) United States Patent
Snedeker et al.

(10) Patent No.: US 6,808,072 B2
(45) Date of Patent: Oct. 26, 2004

(54) APPARATUS FOR CLEANSING HANDS

(76) Inventors: Peter Sedgwick Snedeker, 61 W. Shore Dr., Pennington, NJ (US) 08534; James Phyfe Snedeker, 61 W. Shore Dr., Pennington, NJ (US) 08534

( * ) Notice: Subject to any disclaimer, the term of this patent is extended or adjusted under 35 U.S.C. 154(b) by 0 days.

(21) Appl. No.: 09/892,186

(22) Filed: Jun. 26, 2001

(65) Prior Publication Data

US 2002/0017469 A1 Feb. 14, 2002

Related U.S. Application Data

(60) Provisional application No. 60/217,908, filed on Jul. 13, 2000.

(51) Int. Cl.[7] ..... A45C 11/20

(52) U.S. Cl. ..... 206/542; 206/216; 206/494

(58) Field of Search ..... 206/216, 217, 206/494, 233, 210, 541, 542; 426/112, 115, 124

(56) References Cited

U.S. PATENT DOCUMENTS 3,499,538 A * 3/1970 Sherard ..... 211/85.4
3,920,120 A * 11/1975 Shveda ..... 206/217
3,956,510 A * 5/1976 Molnar ..... 426/106
4,484,350 A 11/1984 Gordon
4,618,992 A 10/1986 La Grotteria
4,941,756 A * 7/1990 Price ..... 383/127
4,953,823 A 9/1990 Sheaffer et al.
4,985,232 A * 1/1991 Jacobssen ..... 206/219
4,993,845 A * 2/1991 Faltynek ..... 206/542
5,056,159 A 10/1991 Zemke, Jr.
5,165,546 A * 11/1992 Jaeger et al. ..... 206/534
5,220,909 A * 6/1993 Pickard et al. ..... 126/246
5,328,265 A 7/1994 Clooney
5,590,783 A * 1/1997 Capy et al. ..... 206/542
5,705,212 A 1/1998 Atkinson
5,808,175 A 9/1998 Chang
5,947,275 A * 9/1999 Hess ..... 206/210
5,992,677 A * 11/1999 Ebine ..... 220/505
5,996,169 A * 12/1999 Cooper ..... 15/105
6,003,190 A 12/1999 Knudsen
6,144,016 A * 11/2000 Garvin ..... 219/387
6,219,846 B1 * 4/2001 Toole ..... 2/49.2

* cited by examiner

*Primary Examiner*—Jila M. Mohandesi
(74) *Attorney, Agent, or Firm*—Kriegsman & Kriegsman

(57) ABSTRACT

A cleaning member, specifically a pad or cloth which is preferably saturated with a wet cleansing solution and is retained within a sealed enclosure and attached to, embedded in or in some way captured by a food holding means to facilitate cleansing during and after consuming of said food.

13 Claims, 9 Drawing Sheets

APPARATUS FOR CLEANSING HANDS

CROSS-REFERENCE TO RELATED APPLICATIONS

This application claims benefit of U.S. provisional patent application Ser. No. 60/217,908, filed Jul. 13, 2000.

| U.S. Patent Documents | | |
|---|---|---|
| 4484350 | November, 1984 | Gordon |
| 4618992 | October, 1986 | LaGrotteria |
| 4941756 | July, 1990 | Price |
| 4953823 | September, 1990 | Sheaffer |
| 5056159 | October, 1990 | Zemke |
| 5328265 | July, 1994 | Clooney |
| 5590783 | January, 1997 | Capy |
| 5705212 | January, 1998 | Atkinson |
| 5808175 | September, 1998 | Chang |
| 6003190 | December, 1999 | Knudsen |

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

1. Field of Invention

This invention relates to cleaning members, specifically to such as a pad or cloth which is preferably saturated with a wet cleansing solution and is retained within a sealed enclosure and attached to, embedded in, or in some way captured by, a food holding means to facilitate cleansing during and after consuming of said food.

2. Description of Prior Art

When eating snack food, or other food normally sold in a bag or other container to facilitate transport thereof, a consumer is often located remotely from conventional washing stations. Many of these foods such as potato chips and nuts tend to be very greasy or oily and the consumer's fingers, and possibly hands, also become frequently soiled or dirty with the residue from these foods which is both uncomfortable and should be cleaned as a matter of normal personal hygiene. In such a situation having a wet premoistened cleaning pad, or other similar device, readily available at such a remote location has not heretofore been possible. To maintain clean fingers and/or hands it is often preferable to wipe them on something such as a user's pants, shirt or cuff. Other times consumers often wipe their fingers and their hands on their jacket or, even worse, they lick their fingers and hands in the absence of any means of cleaning. This leads to the spreading of germs, especially viral germs such as cold germs, when shaking hands with or making personal contact with other individuals at that time or in the immediately subsequent time period. Also, the wiping of one's hands on their clothes produces an unsightly condition on the clothing and can require cleaning more often than otherwise necessary.

The unsanitary condition caused by such licking is definitely a health problem. Individuals are told to wash their hands as often as possible in order to minimize the spreading of viral germs and it is the contact of one's saliva to another's skin surface that often causes the spread of viral infections and also the transmitting of bacteria or other contagious diseases.

Consumers need to maintain clean fingers and hands at all times if possible. When their fingers and their hands become dirty, thus requiring cleaning, the use of their clothing or licking their fingers is not desirable due to the amount of dirt or material that may be wiped on the clothing or the unsanitary condition that may be created by licking their fingers as well as possibly their hands.

Many of those snack foods which are sold in bags, or other transportable containers, are made with oil or grease materials which are very difficult to completely remove from the fingers or hands by merely wiping on a dry napkin or towel.

A number of configurations have been patented for providing cleaning members at remote locations to facilitate cleaning of the hands of an individual. Examples of such patents are shown in U.S. Pat. No. 4,484,350 patented Nov. 20, 1984 to K. N. Gordon on a "Convertible Paper Bag And Doily"; and U.S. Pat. No. 4,618,992 patented Oct. 21, 1986 to J. K. LaGrotteria on a "Bag Convertible To Place Mat"; and U.S. Pat. No. 4,941,756 patented Jul. 17, 1990 to J. S. Price and assigned to John Sterling Price on a "Disposable Bag With Attached Napkin"; and U.S. Pat. No. 4,953,823 patented Sep. 4, 1990 to W. G. Sheaffer et al on a "Coaster And Wipe"; and U.S. Pat. No. 5,056,159 patented Oct. 15, 1991 to W. L. Zemke, Jr. on a "Combination Tray And Bib"; and U.S. Pat. No. 5,328,265 patented Jul. 12, 1994 to N. Clooney on a "Combination Bag And Napkin"; and U.S. Pat. No. 5,590,783 patented Jan. 7, 1997 to G. Capy et al on a "Device Combining A Disposable Napkin With A Fast Food Container, And Method For Continuously Producing Same"; and U.S. Pat. No. 5,705,212 patented Jan. 6, 1998 to P. J. Atkinson on a "Food Package With An Enclosed Eating Utensil"; and U.S. Pat. No. 5,808,175 patented Sep. 15, 1998 to S. Chang and assigned to Vanguard International Semiconductor Corporation on "Solving Production Down Time With Parallel Low Pressure Sensors"; and U.S. Pat. No. 6,003,190 patented Dec. 21, 1999 to C. T. Knudsen on a "Cleaning Pad For Mounting On The Leg Of A Golf Player".

Applying these configurations to readily address the problem inherent in removing residue such as oil or grease from a consumer's hands after eating snack food or other food normally sold in a bag or other containers is beyond their effective capability both in terms of their usage and manufacture.

Aside from their lack of application to the problems herein addressed, such applications suffer from a number of disadvantages when their role in the packaging manufacturing process is taken into consideration:

(a) Snack food or other food normally sold in a bag or other container is packaged at a very high speed. The above inventions are not compatible with such a high speed packaging process and will present great difficulties were they applied to this process.

(b) No packaging equipment currently exists that would permit either the attaching to or the embedded in of a cleaning member as would be required in the use of the above applications. The equipment that performs this function, known in the packaging industry as an "inserter", has only limited capabilities that does not encompass the far more extensive processes that would be required to address the particular requirements of the above patents.

(c) Modifying the aforementioned inserter to accommodate the above applications would be practically, and economically, unfeasible.

BRIEF SUMMARY OF THE INVENTION

In accordance with the present invention a cleaning member comprising a pad or cloth which is preferably saturated with a wet cleansing solution and is retained within a sealed enclosure and attached to, embedded in or in some way captured by a food holding means to facilitate cleansing during and after consuming of said food means to facilitate cleansing during and after consuming of said food.

Accordingly, the objects and advantages of the present are:

(a) to make use of a wet cleaning solution which is a solvent for such oil or grease to cause effective removal thereof.

(b) to permit the incorporation of an antibacterial agent within the wet cleansing solution.

(c) to enable a consumer to more effectively remove the oil and the other materials by placing the pad containing a wet cleaning solution where it can be quickly and easily used with minimal difficulty and no appreciable interruption in the normal ongoing activities of the consumer.

(d) to enable the company packaging the food to incorporate the cleansing pad in the most efficient and cost-effective manner possible. Inserters currently exist that can readily be adapted to place cleaning members in a food holding means. Thus, such a cleaning member can be incorporated within a package of snack food or other food at minimal cost and encumbrance.

(e) to provide a means for attaching of the sealed enclosure containing the cleaning member with respect to the food holding means. This can be achieved by applying a layer of adhesive material to the exterior of the sealed enclosure for the cleaning member or to the food holding means. Many other means can be conceived of retaining the sealed enclosure with the cleaning member therein with respect to the food holding means such as forming multiple layers in the food holding means outer surface or defining a pocket therein or even being clipped thereto or otherwise detachably secured such that the cleaning member is readily accessible once the food contained within the food holding means is consumed.

(f) to provide a cleaning member in a sealed enclosure which is attachable or insertible in some manner with respect to a food holding means wherein the cleaning member can be a wet towel or pad saturated with a moist cleansing solution.

(g) to provide a cleaning member in a sealed enclosure which is attachable or insertible in some manner with respect to a food holding means wherein the cleaning member can be moistened with an antibacterial agent.

(h) to provide a cleaning member in a sealed enclosure which is attachable in some manner with respect to a food holding means wherein the cleaning member can be adhesively attached to the exterior of the food holding means.

(i) to provide a cleaning member in a sealed enclosure which is attachable in some manner with respect to a food holding means wherein the sealed enclosure for the cleaning member can be attached to, or inserted in, the interior of a food holding means.

(j) to provide a cleaning member in a sealed enclosure which is attachable in some manner with respect to a food holding means wherein the sealed enclosure of the cleaning member can be mounted between multiple external layers of the food holding means to facilitate securement thereof and aid in detachment after the food has been consumed at a remote location.

(k) to provide a cleaning member in a sealed enclosure which is attachable in some manner with respect to a food holding means wherein use of the cleaning member at a location remote from conventional washing stations is made possible.

(l) to provide a cleaning member in a sealed enclosure which is attachable in some manner with respect to a food holding means wherein the sealed enclosure is airtight with respect to the external ambient environment to maintain the sanitary condition thereof.

(m) to provide a cleaning member in a sealed enclosure which is attachable in some manner with respect to a food holding means wherein use with snack food holding means is particularly advantageous.

(n) to provide a cleaning member in a sealed enclosure which is attachable in some manner with respect to a food holding means wherein use with oily or otherwise greasy food contained within the food holding means is an important application.

(o) to provide a cleaning member in a sealed enclosure which is attachable in some manner with respect to a food holding means wherein the sealed enclosure can be maintained within one compartment of a multiple holding compartment.

DETAILED DESCRIPTION OF FIGS. DESCRIPTION OF THE PREFERRED EMBODIMENT

Figure 1:
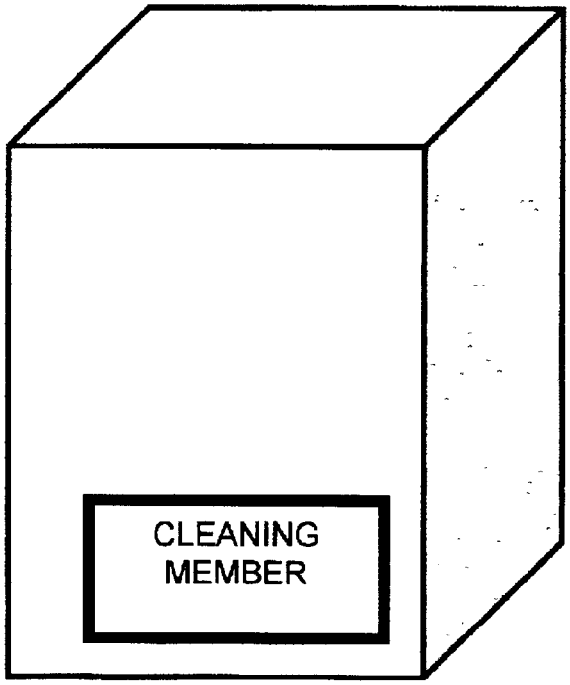
FIG. 1 shows the cleaning member mounted on the outside of a box of food.

While the invention is particularly pointed out and distinctly claimed in the concluding portions herein, a preferred embodiment is set forth in the following detailed description which may be best understood when read in connection with the accompanying drawings, in which:

FIG. 1 is a front perspective illustration of an embodiment of the cleaning member in a sealed enclosure attached with respect to a food holding means wherein the food holding means comprises a box containing food with the sealed enclosure secured to the external surface thereof.

Figure 2:
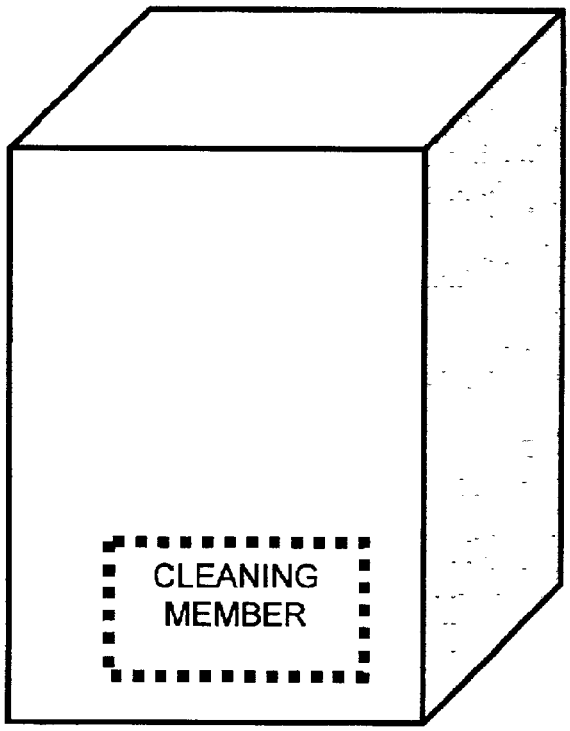
FIG. 2 shows the cleaning member mounted within or placed within a box of food.

FIG. 2 is a front perspective illustration of an embodiment of the cleaning member of the present invention positioned in a sealed enclosure attached with respect to a food holding means wherein the food holding means comprises a box type member and the sealed enclosure is inserted within said box type member.

Figure 3:
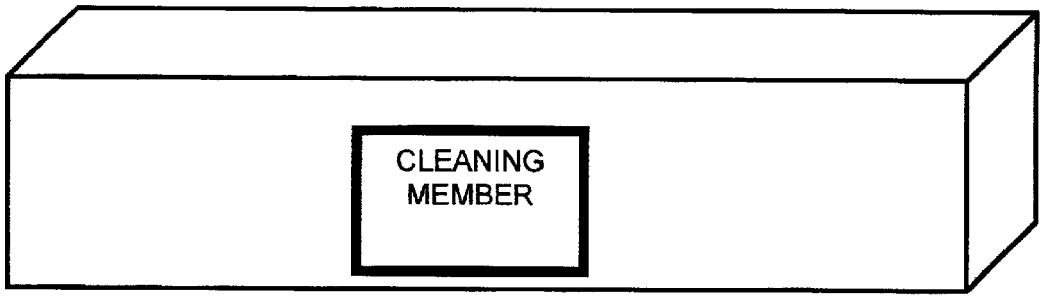
FIG. 3 shows the cleaning member mounted on the outside of an elongated box of food.

FIG. 3 is a front perspective illustration of an embodiment of a cleaning member in a sealed enclosure attached with respect to a food holding means wherein the food holding means comprises a longitudinally extending box and the sealed enclosure is attached to the external surface thereof.

Figure 4:
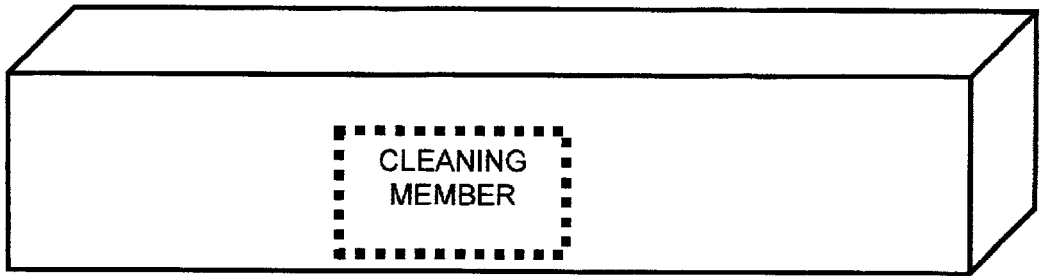
FIG. 4 shows the cleaning member mounted within or placed within a box of food.

FIG. 4 is a front perspective illustration of an embodiment of a cleaning member in a sealed enclosure attached with respect to a food holding means wherein the food holding means comprises a longitudinally extending box and the sealed enclosure is attached to the interior surface thereof.

Figure 5:
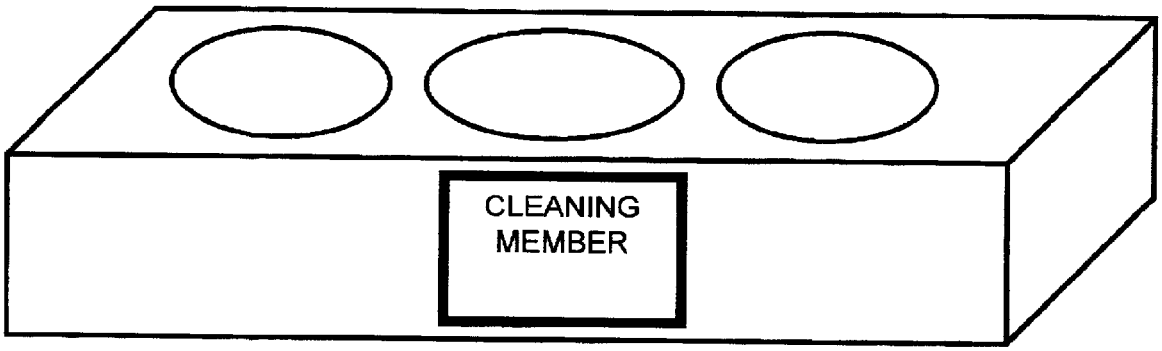
FIG. 5 shows the cleaning member mounted on the outside of a rectangular tray containing various foods.

FIG. 5 is a front perspective illustration of an embodiment of the cleaning member in a sealed enclosure attached with respect to a food holding means of the present invention wherein the food holding means comprises a compartmentalized tray for containing one or more individual foods with the cleaning member attached to the external surface thereof.

Figure 6:
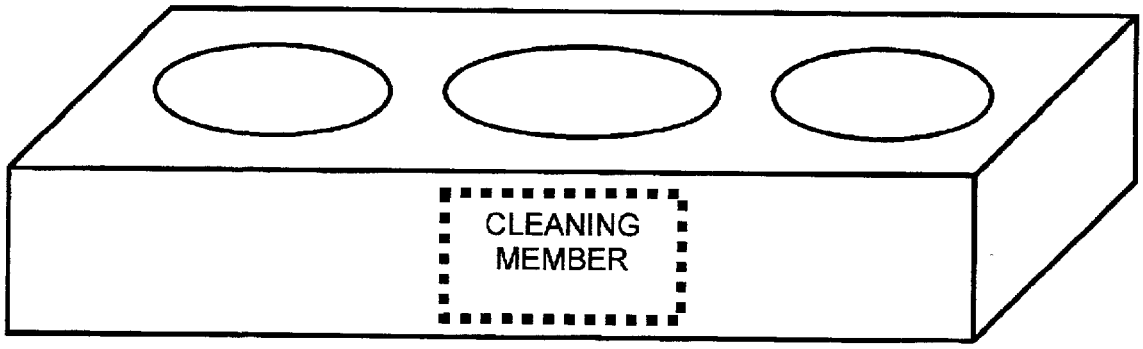
FIG. 6 shows the cleaning member mounted within or placed within a rectangular tray containing various foods.

FIG. 6 is a front perspective illustration of an embodiment of the cleaning member in a sealed enclosure attached with respect to a food holding means of the present invention wherein the food holding means comprises a compartmentalized tray for containing one or more individual foods with the cleaning member attached to the internal surface thereof.

Figure 7:
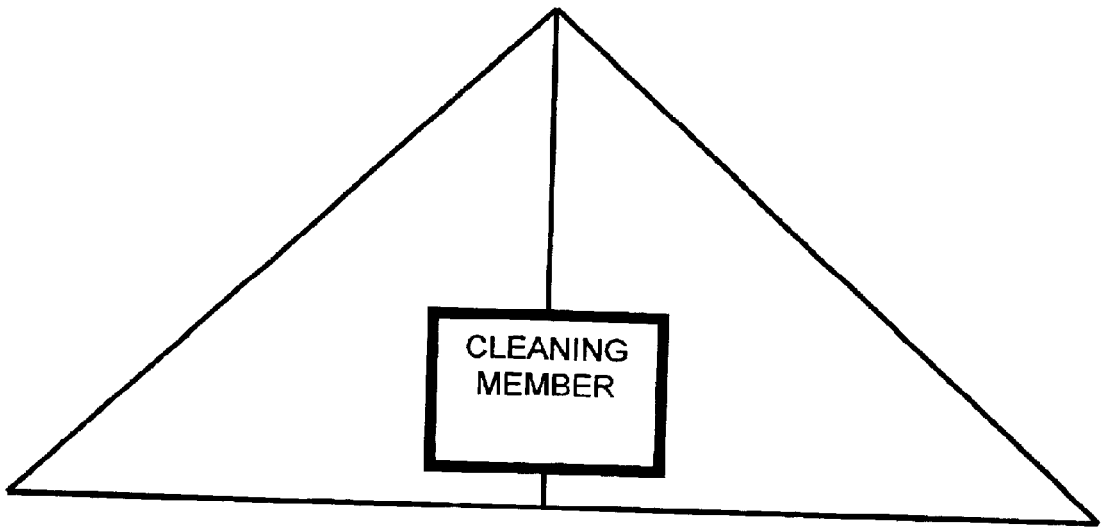
FIG. 7 shows the cleaning member mounted on the outside of a triangular tray containing various foods.

FIG. 7 is a front top plan view of an embodiment of the cleaning member in a sealed enclosure attached with respect to a food holding means of the present invention wherein the food holding means comprises a generally triangular shape box with the sealed enclosure attached to the external surface thereof.

Figure 8:
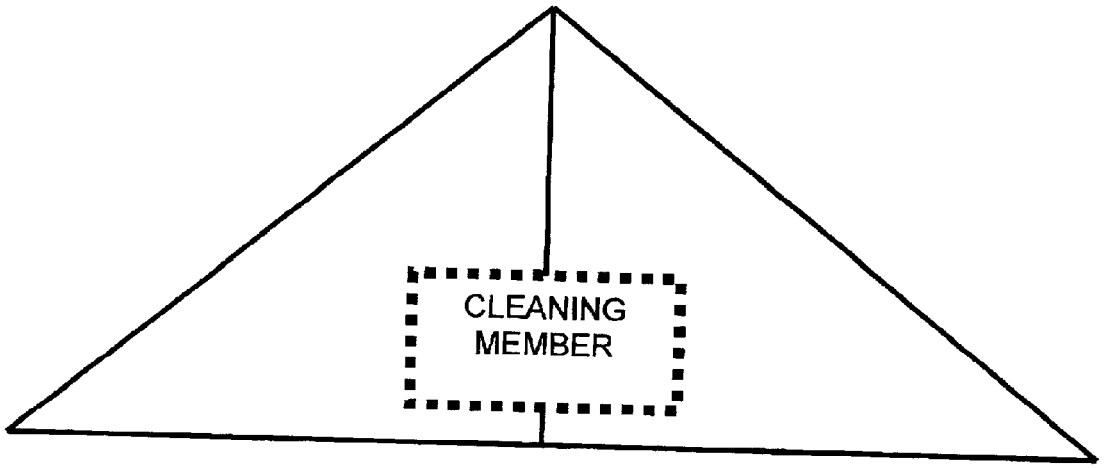
FIG. 8 shows the cleaning member mounted within or placed within a triangular tray containing various foods.

FIG. 8 is a front top plan view of an embodiment of the cleaning member in a sealed enclosure attached with respect to a food holding means of the present invention wherein the food holding means comprises a generally triangular shape box with the sealed enclosure attached to the internal surface thereof.

Figure 9:
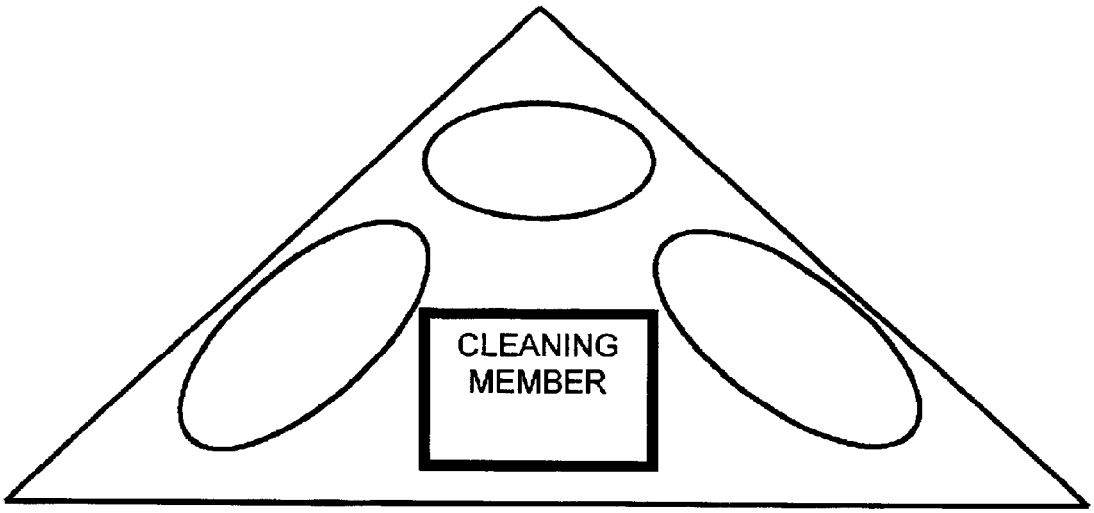
FIG. 9 shows the cleaning member mounted on the outside of a triangular tray containing various foods.

FIG. 9 is a front top plan view of an embodiment of the cleaning member in a sealed enclosure attached with respect to a food holding means of the present invention wherein the food holding means comprises a generally triangular shape compartmentalized box with the sealed enclosure is inserted within said triangular shape box.

Figure 10:
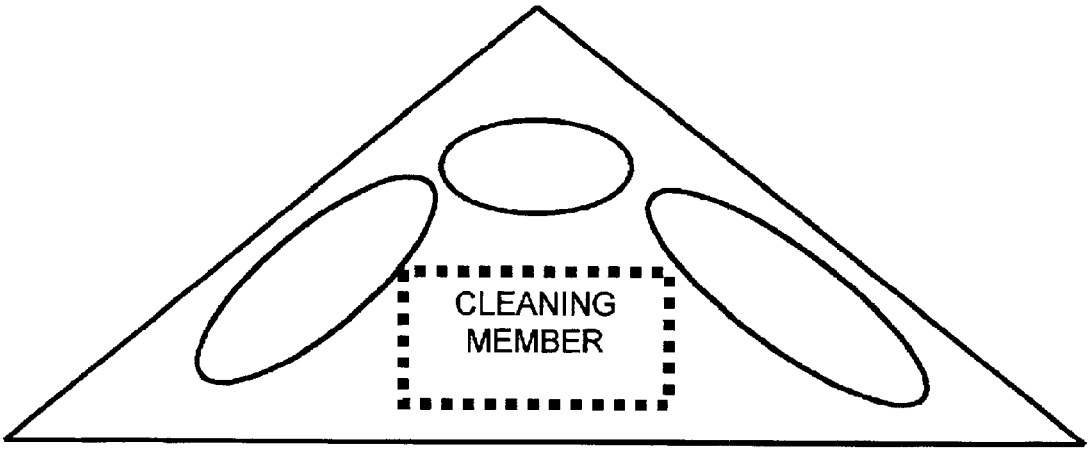
FIG. 10 shows the cleaning member mounted within or placed within a triangular tray containing various foods.

FIG. 10 is a front top plan view of an embodiment of the cleaning member in a sealed enclosure attached with respect to a food holding means of the present invention wherein the food holding means comprises a generally triangular shape compartmentalized box with the sealed enclosure attached to the internal surface thereof.

Figure 11:
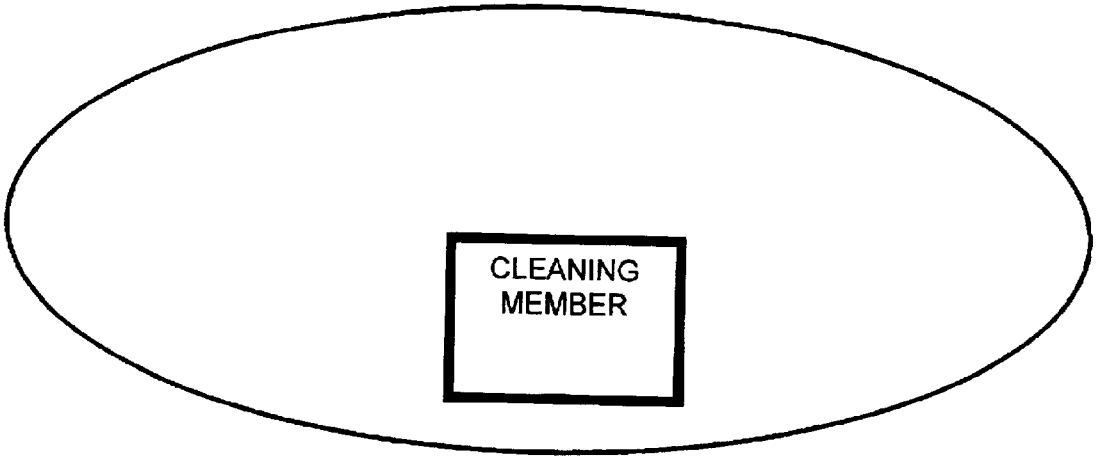
FIG. 11 shows the cleaning member mounted on the outside of an oblong or circular tray containing various foods.

FIG. 11 is an embodiment of the cleaning member in a sealed enclosure attached with respect to a food holding means of the present invention wherein the food holding means comprises an oval food bag or box with the sealed enclosure attached to the external surface thereof.

Figure 12:
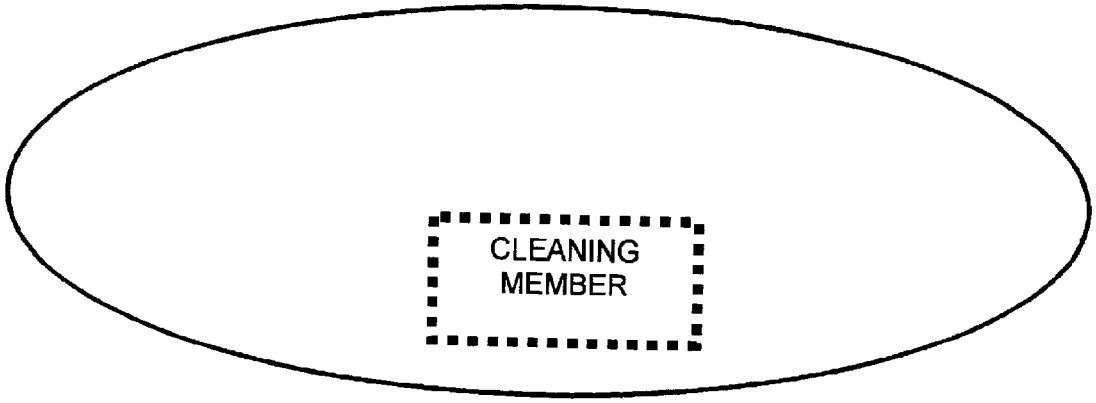
FIG. 12 shows the cleaning member mounted within or placed within an oblong or circular tray containing various foods.

FIG. 12 is an embodiment of the cleaning member in a sealed enclosure attached with respect to a food holding means of the present invention wherein the food holding means comprises an oval food bag or box with the sealed enclosure attached to the internal surface thereof.

Figure 13:
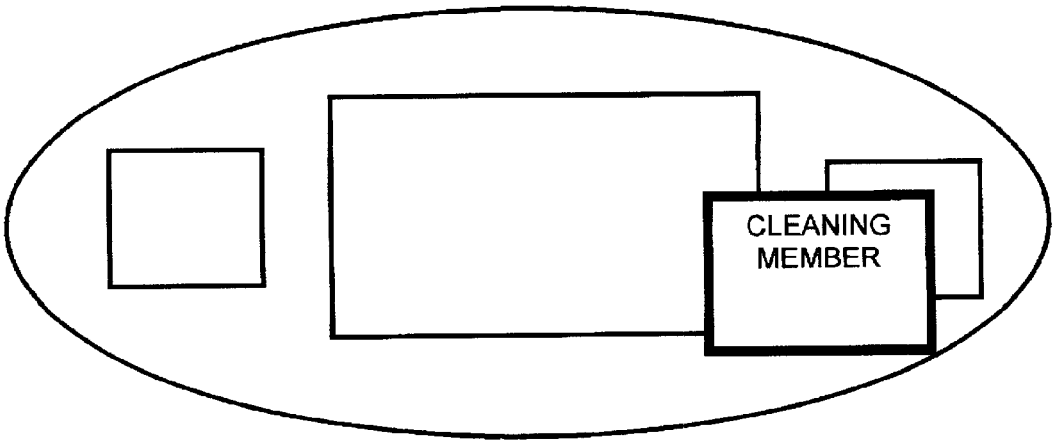
FIG. 13 shows the cleaning member mounted on the outside of an oblong or circular tray containing various foods.

FIG. 13 is a preferred embodiment of a cleaning member in a sealed enclosure attached with respect to a food holding means of the present invention wherein the food holding means comprises an oval compartmentalized bag or tray with the cleaning pad secured to the external surface thereof.

Figure 14:
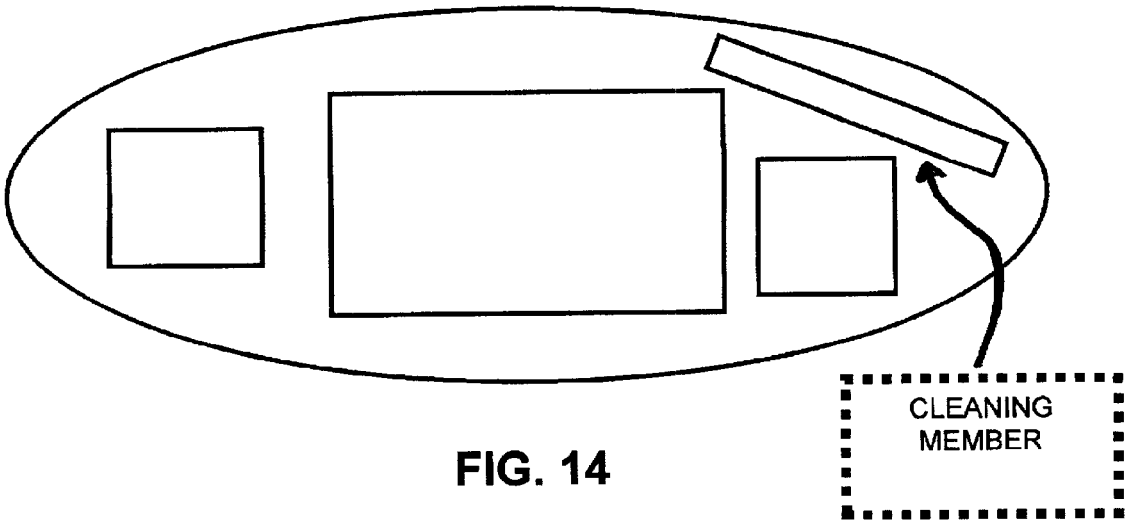
FIG. 14 shows the cleaning member mounted within or placed within an oblong or circular tray containing various foods. In this embodiment the manufacturer of the tray had created a separate place for the cleaning member to be held.

FIG. 14 is a preferred embodiment of a cleaning member in a sealed enclosure attached with respect to a food holding means of the present invention wherein the food holding means comprises an oval compartmentalized bag or tray with the cleaning pad positioned in a sealed enclosure in one of the compartments thereof.

Figure 15:
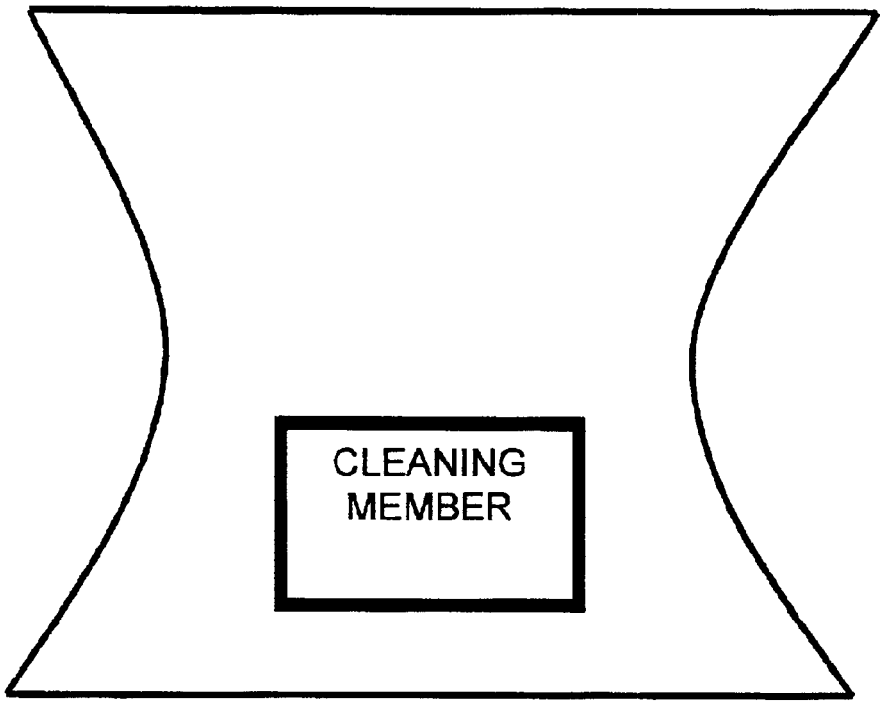
FIG. 15 shows the cleaning member mounted on the outside of a bag containing food.

FIG. 15 is a front plan view of an embodiment of a cleaning member in a sealed enclosure attached with respect to a food holding means of the present invention wherein the food holding means comprises a bag containing foods including snack foods with the cleansing pad positioned within a sealed enclosure attached to the external surface of said bag.

Figure 16:
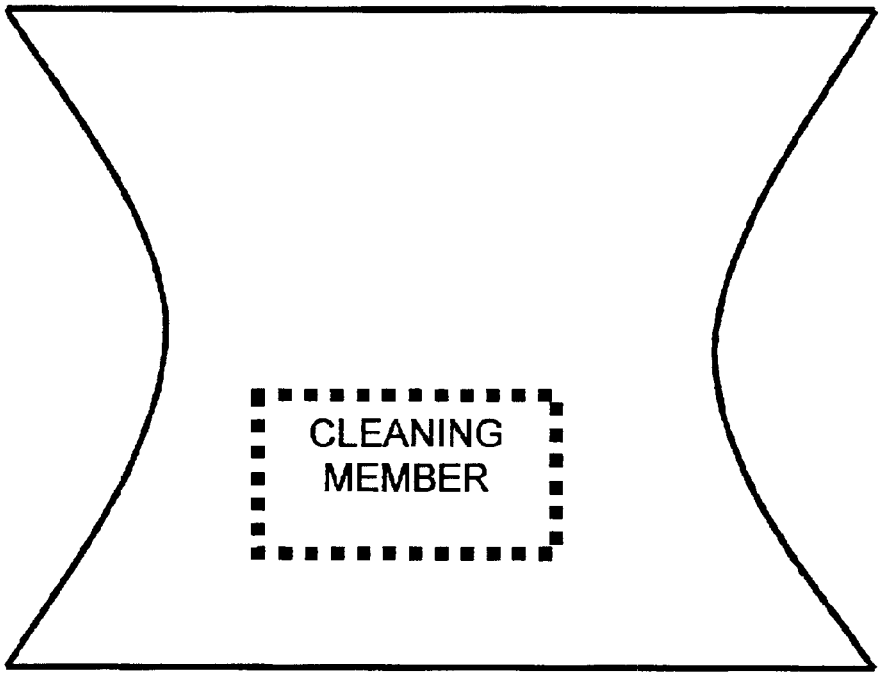
FIG. 16 shows the cleaning member mounted within or placed within a bag containing food.
Figure 17:
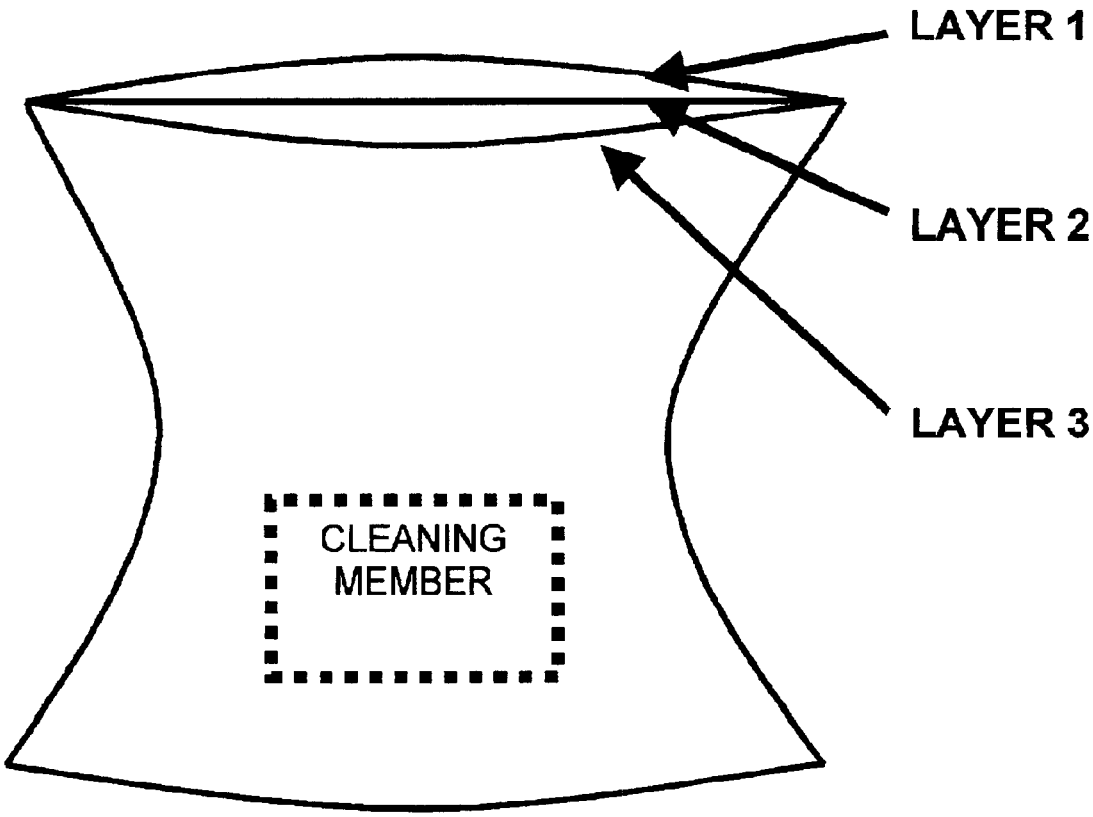
FIG. 17 shows the cleaning member inserted within a pocket created by adding an additional layer of packaging material to the package.

FIG. 16 is a front plan view of an embodiment of a cleaning member in a sealed enclosure attached with respect to a food holding means of the present invention wherein the food holding means comprises a bag containing foods including snack foods with the cleaning pad positioned within a sealed enclosure is inserted within said bag, and FIG. 17 is a preferred embodiment of a cleaning member in a sealed enclosure attached with respect to a food holding means of the present invention wherein the food holding means comprises a bag type container which is formed of a plurality of individual layers to define sleeves there between to facilitate receiving therein of the cleaning member mounted in a sealed enclosure detachably secured between layers of the food holding external bag surface.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

DETAILED DESCRIPTION OF THE INVENTION

When eating snack food or other food normally sold in a bag or other container to facilitate transport thereof a consumer is often located remotely from conventional washing stations. Many of these foods such as potato chips and nuts tend to be very greasy or oily and the consumer's fingers and possibly hands also frequently become soiled or dirty with the residue from these foods which is both uncomfortable and should be cleaned as a matter of normal personal hygiene. In such a situation having a wet pre-moistened cleaning pad or other similar device readily available at such a remote location has not heretofore been possible. To maintain clean fingers and/or hands it is often preferable to wipe them on something such as a user's pants, shirt or cuff. Other times consumers often wipe their fingers and their hands on their jacket or, even worse, they lick their fingers and hands in the absence of any means of cleaning. This leads to the spreading of germs, especially viral germs such as cold germs, when shaking hands with or making personal contact with other individuals at that time or in the immediately subsequent time period. Also the wiping of one's hands on their clothes produces an unsightly condition on the clothing and can require cleaning more often than otherwise necessary. The unsanitary condition caused by such licking is definitely a health problem. Individuals are told to wash their hands as often as possible in order to minimize the spreading of viral germs and it is the contact of one saliva to another's skin surface that often causes the spread of viral infections and also the transmitting of bacteria or other contagious diseases.

Consumers need to maintain clean fingers and hands at all times if possible. When their fingers and their hands become dirty, thus requiring cleaning, the use of their clothing or licking their fingers is not desirable due to the amount of dirt or material that may be wiped on the clothing or the unsanitary condition that may be created by licking their fingers as well as possibly their hands.

Many snack foods sold in bags, or other transportable containers, are made with oil or grease materials which are very difficult to completely remove from the fingers or hands by merely wiping on a dry napkin or towel.

This invention relates to a method and apparatus for the cleansing of hands during and after the consumption of food. Such food may be contained in food containers that can take a variety of shapes or sizes or configurations such as bags, foam plastic containers, trays, boxes or other housing type configurations.

Accordingly, the reader will see that the present invention provides a means for allowing a person to clean their hands after consuming of a snack food when positioned at a remote location with respect to conventional washing apparatus such as restrooms or wash sinks.

It is common that snack foods are sold in bags, boxes or other containers or food holding means to allow them to be consumed whenever and wherever a consumer wishes to eat the food product therein. Many of these bags are made with oil and grease impervious liners to prevent the oil and grease which is commonly found in such snack foods from penetrating the container and soiling the surrounding environment including a user's hands or a user's clothing, pocket or car seat or back pack.

However, when the consumer decides to eat the product it is virtually impossible to keep the oil or grease off of the consumer's hands or fingers. It is at this time that some type of cleaning mechanism is preferred and necessary. Often these products are consumed at locations where no washing facilities are available. Under these conditions the present invention provides a means for cleaning of one's hands to prevent soiling of the hands and clothes and surrounding environment of the consumer even in the situation where the consumer is not near any conventional means of washing.

This cleaning capability is achieved by the inclusion of cleaning member such as a towel or pad with respect to the food holding means. This cleaning member preferably will be contained within a sealed enclosure to maintain its sanitary condition prior to usage thereof. The user will then tear open the sealed enclosure making the cleaning member available such that the user can clean his or her hands and fingers and any other areas which have become soiled during the consumption of the food product held within the food holding means.

This cleaning member can comprise a dry towel or pad but preferably is moistened with some type of a cleaning solution in order to enhance the cleaning characteristics thereof especially when used with food holding means which contain food products which tend to be oily and greasy such as the snack foods potato chips and shelled nuts.

It is often preferable that the cleaning member in the sealed enclosure perhaps be impregnated with an antibacterial element to prevent the spread of bacteria from the user's hands to perhaps other individuals which may indeed share in consuming of the same food product. This antibacterial member will preferably be somewhat moistened in order to insure its adherence with respect to the entire surface of the cleaning member. This moistened antibacterial element or moistened cleaning element will be maintained in a slightly moistened condition on the cleaning member due to the fact that the sealed enclosure is airtight with respect to the surrounding ambient environment. It should be appreciated that the cleaning member mounted within the sealed enclosure can be attached with respect to the food holding means in many different ways. First of all such sealed enclosure can be attached with respect to the interior or exterior thereof. It can be stapled, clipped, glued or otherwise held thereto by any type of adhesive or simply inserted into such container. This means of securement can be made with respect to the internal or external surface of the food holding means.

A number of configurations have been patented for providing cleaning members at remote locations to facilitate cleaning of the hands of an individual. Applying these configurations to readily address the problem inherent in removing residue such as oil or grease from a consumer's hands after eating snack food or other food normally sold in a bag or other containers is beyond their effective capability both in terms of their manufacture and usage.

In addition, such applications suffer from a number of disadvantages when their role in the packaging manufacturing process is taken into consideration:

(a) Snack food or other food normally sold in a bag or other container is packaged at a very high speed. The above inventions are not compatible with such a high speed packaging process and will present great difficulties were they applied to this process.

(b) No packaging equipment currently exists that will permit either the attaching to or the embedded in of a cleaning member as would be required in the use of the above applications. The equipment that performs this function, known in the packaging industry as an "inserter", has only limited capabilities that does not encompass the far more extensive processes that would be required to address the particular requirements of the above patents.

(c) Modifying the aforementioned inserter to accommodate the above applications would be practically, and economically, unfeasible.

What is claimed is:

1. A snack food assembly comprising:

(a) a snack food bag having a sealed snack food compartment;

(b) a snack food disposed within said sealed snack food compartment, said snack food comprising an oily food selected from the group consisting of chips and nuts;

(c) a moistened towelette; and (d) an airtight sealed enclosure coupled to said snack food bag, said moistened towelette being disposed within said airtight sealed enclosure.

2. The snack food assembly as claimed in claim 1 wherein said moistened towelette is moistened with a cleansing solution.

3. The snack food assembly as claimed in claim 2 wherein said cleansing solution includes an antibacterial agent.

4. The snack food assembly as claimed in claim 1 wherein said snack food bag has an exterior and wherein said airtight sealed enclosure is secured to the exterior of said snack food bag.

5. The snack food assembly as claimed in claim 4 wherein said airtight sealed enclosure is attached to the exterior of said snack food bag by an adhesive.

6. The snack food assembly as claimed in claim 5 wherein said airtight sealed enclosure is detachably attached to the exterior of said snack food bag.

7. The snack food assembly as claimed in claim 1 wherein said snack food comprises potato chips.

8. The snack food assembly as claimed in claim 1 wherein said snack food comprises nuts.

9. A snack food assembly comprising:

(a) a snack food bag having a sealed snack food compartment;

(b) a snack food disposed within said sealed snack food compartment of said snack food bag, said snack food comprising an oily food selected from the group consisting of chips and nuts;

(c) a moistened towelette; and (d) an airtight sealed enclosure, said moistened towelette being disposed within said airtight sealed enclosure, said airtight sealed enclosure is being disposed within said sealed snack food compartment of said snack food bag.

10. The snack food assembly as claimed in claim 9 wherein said airtight sealed enclosure is attached to the interior of said sealed snack food compartment by an adhesive.

11. The snack food assembly as claimed in claim 10 wherein said airtight sealed enclosure is detachably attached to the interior of said sealed snack food compartment.

12. A snack food assembly comprising:

(a) a snack food bag, said snack food bag comprising a plurality of packaging layers defining first and second sealed compartments;

(b) a snack food disposed within said first sealed compartment of said snack food bag, said snack food comprising an oily food selected from the group consisting of chips and nuts; and (c) a moistened towelette, said moistened towelette being disposed within said second sealed compartment.

13. The snack food assembly as claimed in claim 12 further comprising an airtight sealed enclosure disposed within said second sealed compartment, said moistened towelette being disposed within said airtight sealed enclosure.

* * * * *